US006889856B2

(12) United States Patent
Clark et al.

(10) Patent No.: US 6,889,856 B2
(45) Date of Patent: May 10, 2005

(54) SHELF TRAY APPARATUS FOR ABSORBENT ARTICLES PACKAGED IN FLEXIBLE FILM

(75) Inventors: Sean Thomas Clark, Cincinnati, OH (US); Chris Joseph Kazakeos, Hitchin (GB); Carol Anne Leong-Son, West Byfleet (GB); Todd Hayley Parker, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/465,343

(22) Filed: Jun. 19, 2003

(65) Prior Publication Data

US 2004/0256340 A1 Dec. 23, 2004

(51) Int. Cl.[7] ..... A47F 5/00
(52) U.S. Cl. ..... 211/184
(58) Field of Search ..... 211/184, 43, 85.28

(56) References Cited

U.S. PATENT DOCUMENTS

| | | | | | |
|---|---|---|---|---|---|
| 575,294 | A | * | 1/1897 | Borden | 211/184 |
| 2,197,789 | A | * | 4/1940 | Dalton | 211/85 |
| 3,856,137 | A | | 12/1974 | Brindley | |
| 3,857,482 | A | | 12/1974 | Shelton | |
| 3,927,761 | A | | 12/1975 | Boyle | |
| 4,025,039 | A | | 5/1977 | Croll et al. | |
| 4,082,046 | A | | 4/1978 | Baglin | |
| 4,235,338 | A | | 11/1980 | Dugan et al. | |
| 4,363,400 | A | | 12/1982 | Lewis | |
| 4,476,985 | A | | 10/1984 | Norberg et al. | |
| 4,485,922 | A | | 12/1984 | Desmond et al. | |
| 4,494,658 | A | | 1/1985 | Simon et al. | |
| 4,714,165 | A | * | 12/1987 | Solomon | 211/11 |
| 4,744,463 | A | | 5/1988 | Merzon | |
| 4,756,409 | A | | 7/1988 | Murray | |
| 4,762,235 | A | | 8/1988 | Howard et al. | |
| 4,832,199 | A | | 5/1989 | Rigby | |
| 4,905,847 | A | * | 3/1990 | Hanson | 211/184 |
| 5,056,668 | A | | 10/1991 | Berger | |
| 5,069,349 | A | | 12/1991 | Wear et al. | |
| 5,180,052 | A | | 1/1993 | Smith et al. | |
| 5,794,796 | A | | 8/1998 | Weisburn | |

(Continued)

FOREIGN PATENT DOCUMENTS

| | | |
|---|---|---|
| CA | 974485 | 9/1975 |
| DE | 8 520 125.1 U1 | 1/1986 |

(Continued)

*Primary Examiner*—Hugh B. Thompson, II
*Assistant Examiner*—Sarah Purol
(74) *Attorney, Agent, or Firm*—Jack L. Oney, Jr.; Jay A. Krebs; Ken K. Patel

(57) ABSTRACT

A shelf display apparatus for absorbent articles which are packaged in a flexible film. The apparatus has a substantially horizontal bottom wall and a support structure which together provide a storage region adapted to store substantially upright the absorbent articles. The support structure may include an upstanding side wall which may have ribs to improve package stability, windows to improve product visibility and/or magnets to improve apparatus stability. Another support structure may include a plurality of partitions and a plurality of recesses. The apparatus may also have an advertising panel adapted to display product information relating to the absorbent articles. The product information may refer to a particular product version of the absorbent articles which are stored in close proximity to a plurality of similarly stored absorbent articles. Absorbent articles may include disposable diapers, sanitary napkins, tampons, and pantiliners.

8 Claims, 15 Drawing Sheets

U.S. PATENT DOCUMENTS

| | | | | | |
|---|---|---|---|---|---|
| 5,873,472 | A | | 2/1999 | Weisburn | |
| 5,913,424 | A | | 6/1999 | Kelly et al. | |
| 5,971,165 | A | * | 10/1999 | Levins | 211/43 |
| 6,152,305 | A | | 11/2000 | Green | |
| 6,227,385 | B1 | | 5/2001 | Nickerson | |
| 6,334,539 | B1 | | 1/2002 | Jajko et al. | |
| 6,354,446 | B1 | * | 3/2002 | Chang | 211/43 |
| 6,409,028 | B2 | | 6/2002 | Nickerson | |
| 2002/0108916 | A1 | | 8/2002 | Nickerson | |
| 2003/0042214 | A1 | | 3/2003 | Virvo | |

FOREIGN PATENT DOCUMENTS

| | | | |
|---|---|---|---|
| DE | 8 532 469 | U1 | 2/1986 |
| DE | 29517504 | U1 | 1/1996 |
| DE | 20007343 | U1 | 7/2000 |
| EP | 0 613 829 | B1 | 9/1994 |
| EP | 0 614 638 | A2 | 9/1994 |
| JP | 1996047741 | A | 2/1996 |

* cited by examiner

SHELF TRAY APPARATUS FOR ABSORBENT ARTICLES PACKAGED IN FLEXIBLE FILM

FIELD OF INVENTION

The present invention relates to a shelf tray apparatus for storing absorbent articles packaged in a flexible film in a substantially upright position on a shelf.

BACKGROUND OF THE INVENTION

Consumer products are commonly sold in retail stores that market such products by placing them on store shelves. Many consumer products are free-standing (e.g., cereal boxes, cans of soup) such that they do not require a support apparatus to be placed on a shelf. Other consumer products, however, are not substantially free-standing. Of these non-substantially-free-standing products, some of them require a particular orientation on the shelf (e.g., packages that have oriented surface indicia). One particular example of interest is absorbent articles (e.g., disposable diapers, sanitary napkins, tampons, and pantiliners).

Many absorbent articles are packaged in flexible film (e.g., low density polyethylene). Once packaged, the resulting-package shape is generally rectangular in shape. Such rectangular shapes typically have a larger front and rear surface which provides the most surface area for the placement of surface indicia (e.g., graphics, text, pictures). However, basic scientific principles (e.g., center of gravity) dictate that the rectangular shape package is most stabile when placed on one of these larger surfaces. Thus, the surface indicia is not seen by the consumer, especially when one package is stacked on top of another. If the consumer can not find their desired product on the shelf amongst a multitude of stacked packages, then the consumer is unlikely to purchase your product. Furthermore, when the consumer searches through the several stacks, they are more likely to mix the product versions with one another. In addition to the consumer's frustrations, the store clerk has similar difficulties when attempting to determine reorder amounts and proper product placement.

What is needed is a shelf display apparatus to store absorbent articles which are packaged in a flexible film in a substantially upright position. Such an apparatus would present these packages in a better orientation resulting in improved product identification for both the consumer and store clerk.

SUMMARY OF THE INVENTION

The present invention provides a shelf display apparatus for absorbent articles which are packaged in a flexible film. The apparatus has a substantially horizontal bottom wall and a support structure which together provide a storage region adapted to store substantially upright the absorbent articles. The support structure may include an upstanding side wall which may have ribs to improve package stability, windows to improve product visibility and/or magnets to improve apparatus stability. Another support structure may include a plurality of partitions and a plurality of recesses. The apparatus may also have an advertising panel adapted to display product information relating to the absorbent articles. The product information may refer to a particular product version of the absorbent articles which are stored in close proximity to a plurality of similarly stored absorbent articles. Absorbent articles may include disposable diapers, sanitary napkins, tampons, and pantiliners.

All documents cited are, in relevant part, incorporated herein by reference; the citation of any document is not to be construed as an admission that it is prior art with respect to the present invention.

BRIEF DESCRIPTION OF THE DRAWINGS

While the specification concludes with claims which particularly point out and distinctly claim the present invention, it is believed that the present invention will be better understood from the following description of preferred embodiments, taken in conjunction with the accompanying drawings, in which like reference numerals identify like elements and numbers with the same final two digits indicate corresponding elements among embodiments, wherein:

DETAILED DESCRIPTION OF THE INVENTION

Definitions

The following terminology is used herein consistent with the plain meaning of the terms with further details provided in the present specification.

The term "joined" herein encompasses configurations whereby a material or component is secured directly or indirectly (by one or more intermediate members) to another material or component. An example of indirect joining is an adhesive. Direct bonding includes heat, pressure bonding, unitary construction through injection molding, and the like. Joining may include any means known in the art including, for example, adhesives, heat bonds, pressure bonds, force fitting, unitary construction through injection molding, and the like.

Reference will now be made in detail to various exemplary embodiments of the invention, several of which are also illustrated in the accompanying drawings.

Figure 1:
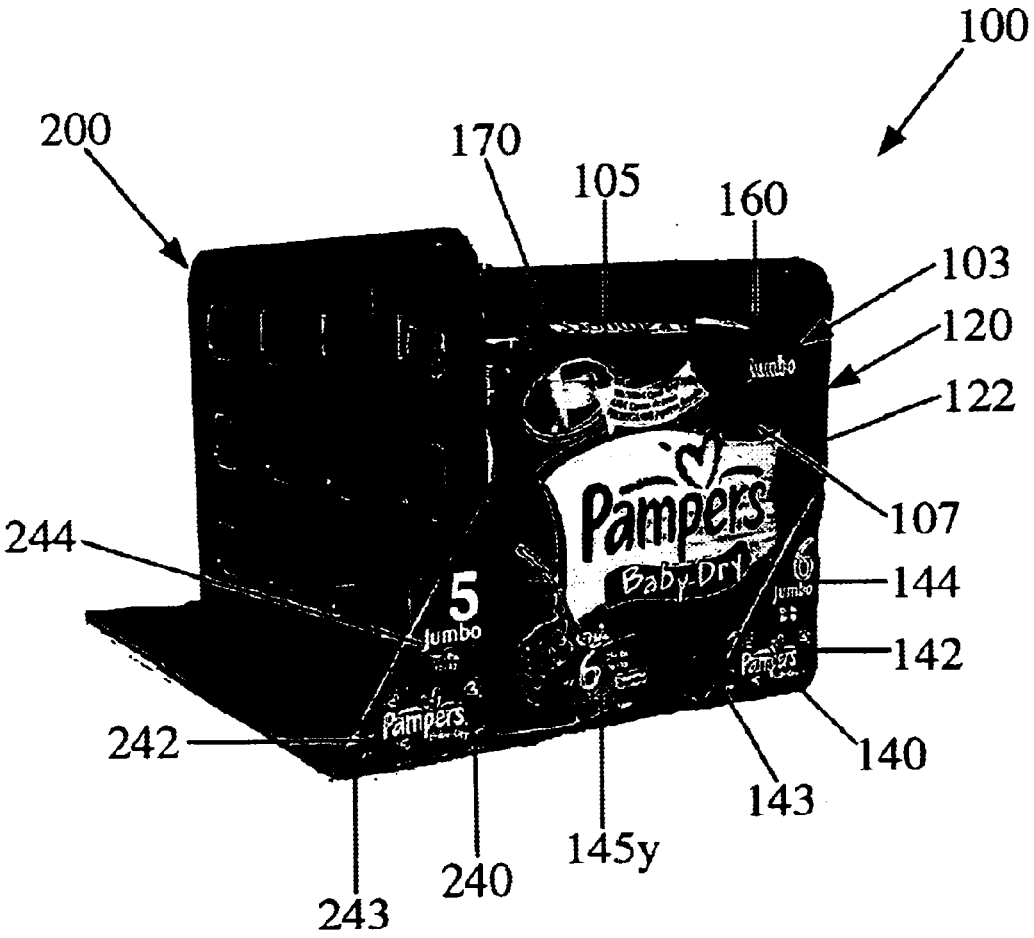
FIG. 1 is a perspective view of a shelf display apparatus with an absorbent article packaged in a flexible film in accordance with the present invention; a second apparatus is also shown to illustrate adjacent storage of said apparatuses.
Figure 2:
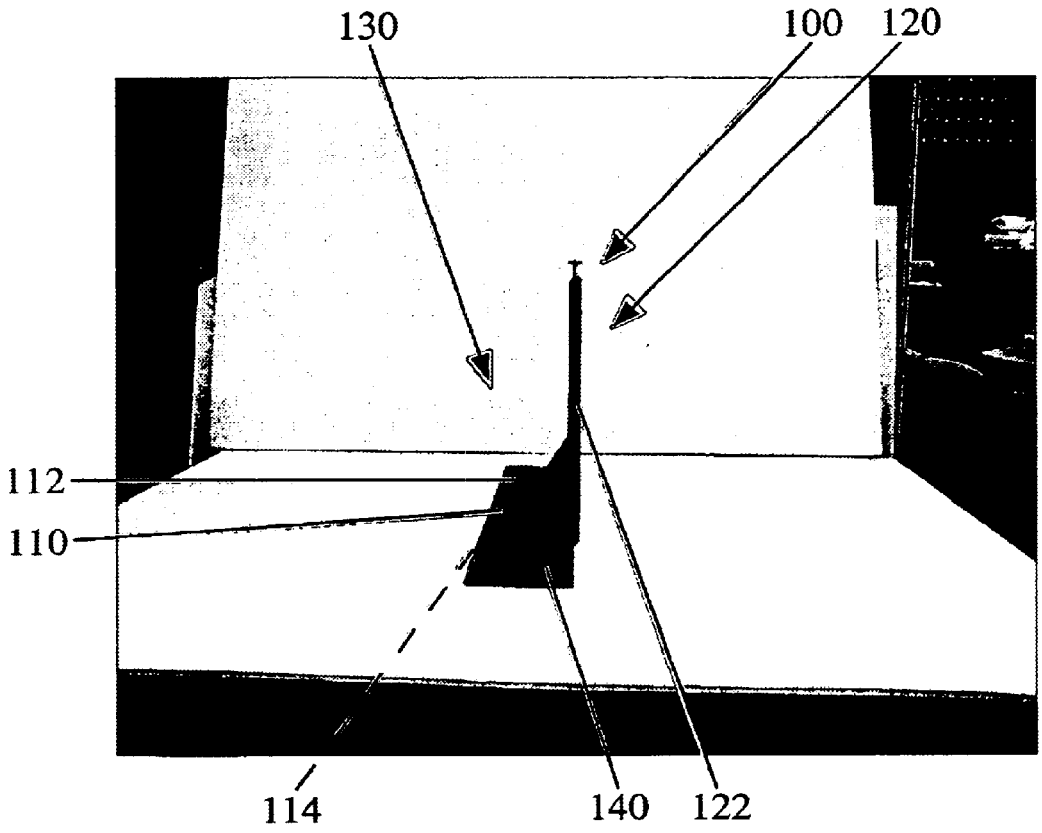
FIG. 2 is a front view of the apparatus in FIG. 1 without the absorbent article.
Figure 3:
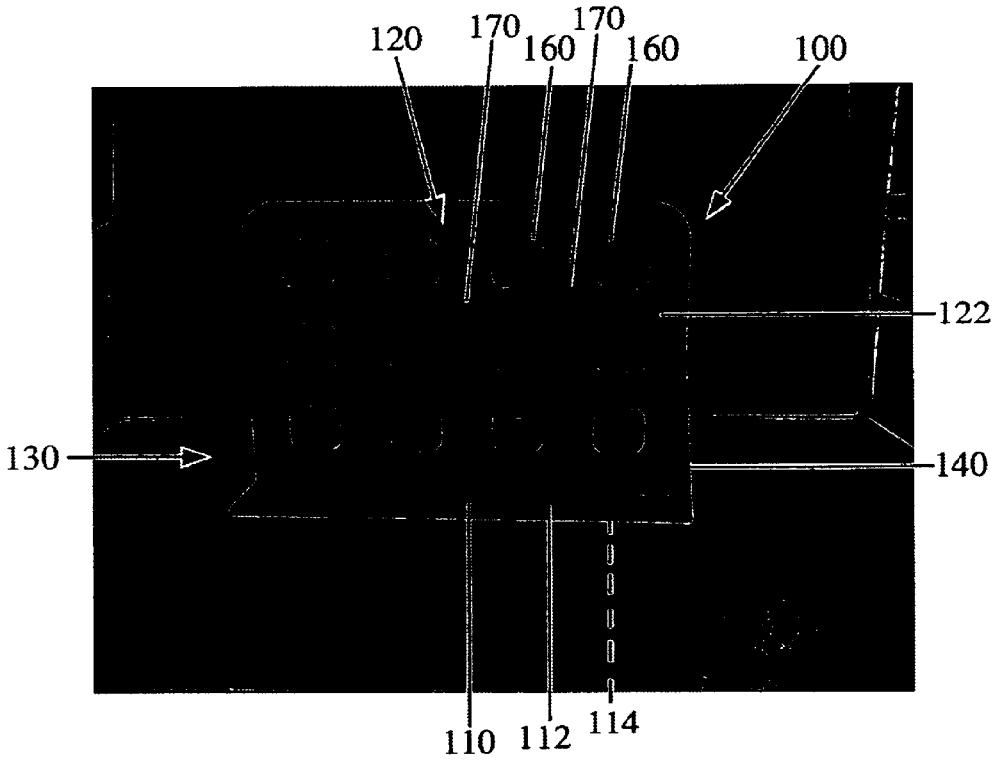
FIG. 3 is a left side view of the apparatus in FIG. 1 without the absorbent article.
Figure 4:
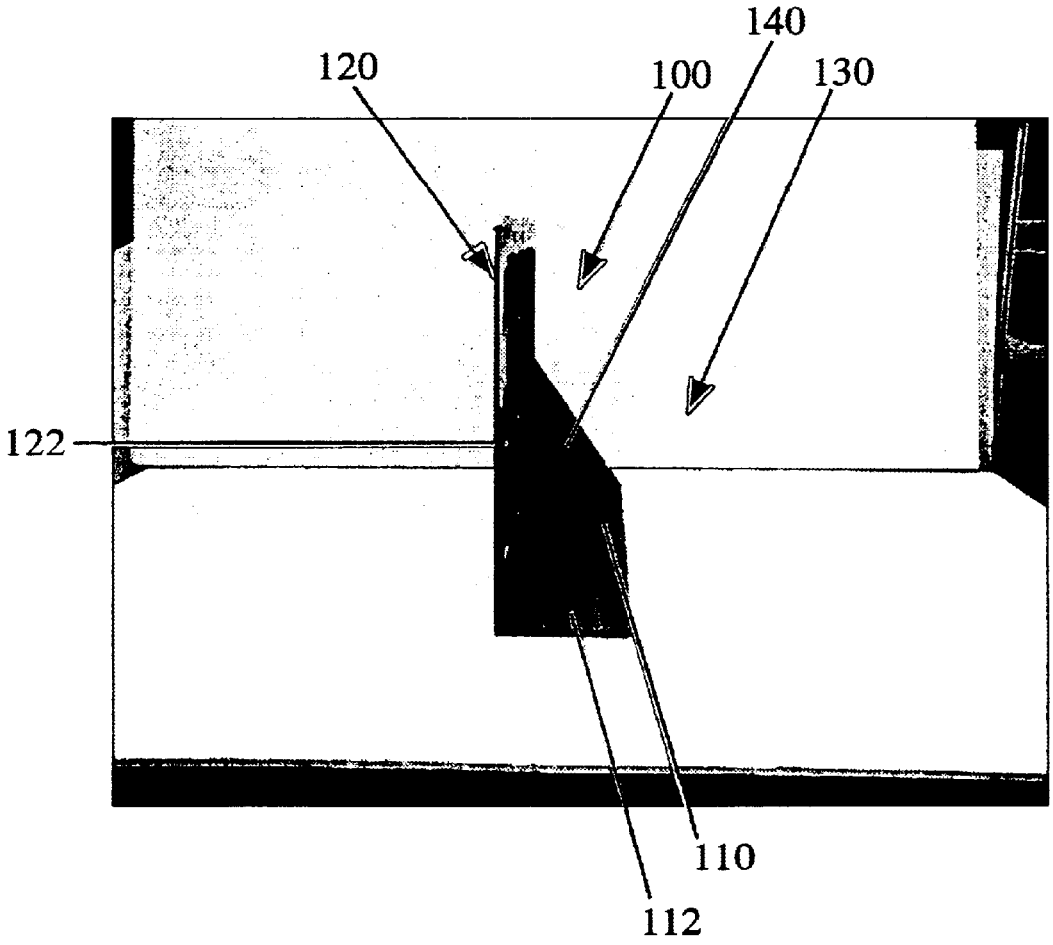
FIG. 4 is a rear view of the apparatus in FIG. 1 without the absorbent article.
Figure 5:
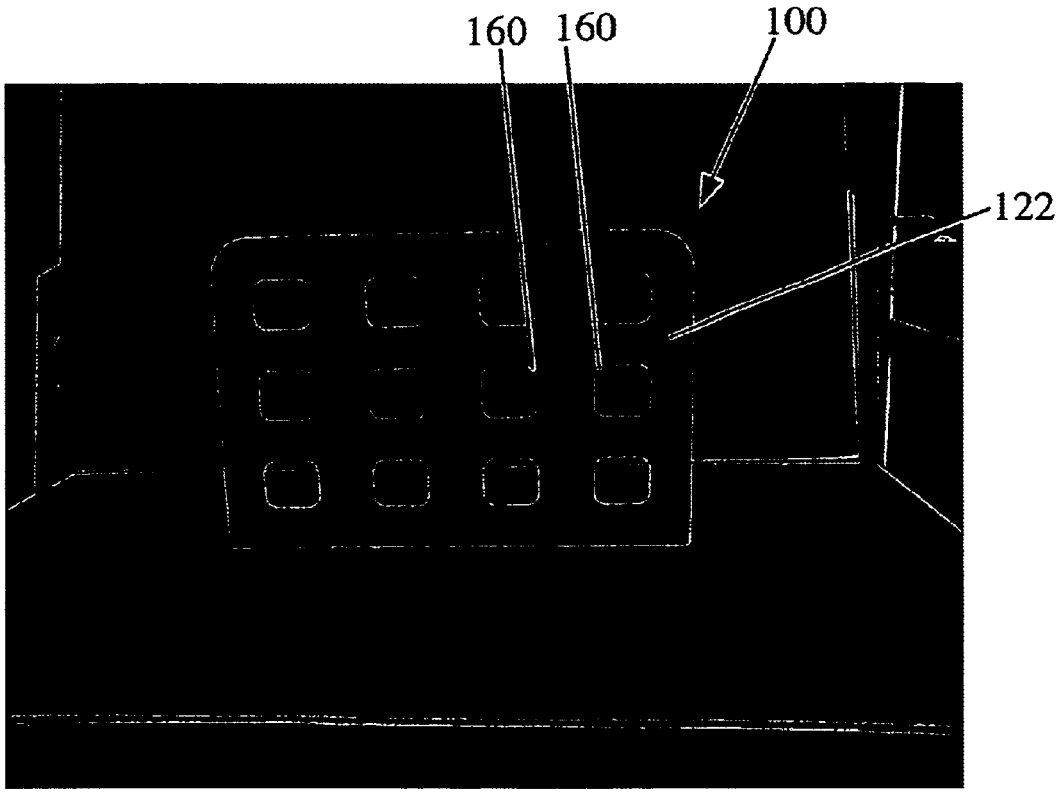
FIG. 5 is a right side view of the apparatus in FIG. 1 without the absorbent article.
Figure 6:
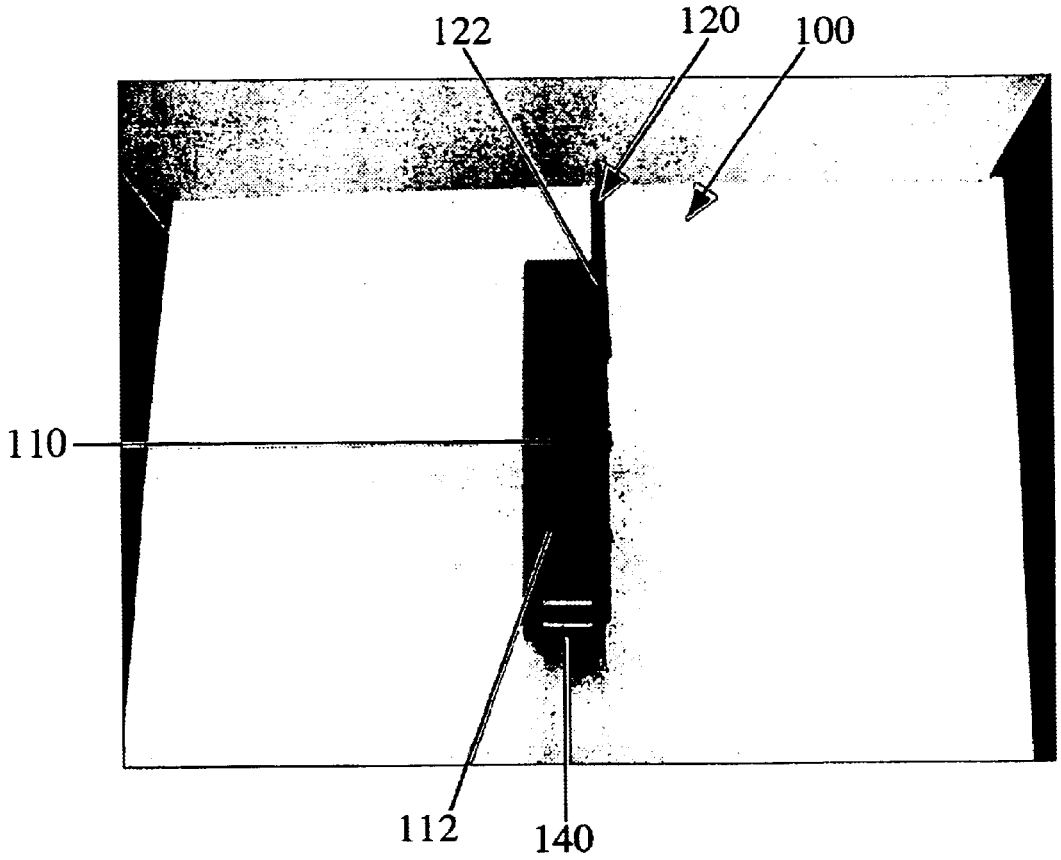
FIG. 6 is a top view of the apparatus in FIG. 1 without the absorbent article.

FIG. 1 depicts a non-limiting exemplary embodiment of a shelf display apparatus 100 which is adapted to store absorbent articles 103 which are packaged in a flexible film 105 on a shelf (not shown). The absorbent articles 103 packaged in a flexible film 105 are typically substantially rectangular in shape and have surface indicia on at least one of its major surface area sides 107. Preferably, apparatus 100 is adapted to store absorbent articles 103 such that major surface area 107 having surface indicia is facing towards the direction of the consumer (e.g., front of shelf).

FIGS. 1–7 depict apparatus 100 having a substantially horizontal bottom wall 110, wherein said bottom wall 110 has a first surface 112 and a second surface 114, and a support structure 120. Bottom wall 110 provides a base platform for apparatus 100 to be placed on a shelf. Bottom wall first surface 112 is the upper side of bottom wall 110 and bottom wall second surface 114 is the lower side of bottom wall 110. Support structure 120 may be designed to have a substantially upstanding side wall 122 and a resulting storage region 130 for storing absorbent articles 103. More specifically, substantially upstanding side wall 122 is joined to and extends upwardly from bottom wall first surface 112. Substantially upstanding side wall 122 and bottom wall first surface 112 together form a storage region 130. Apparatus 100 may also include an advertising panel 140 to display product information 142, 144 relating to absorbent articles 103. Product label 143 may be affixed to advertising panel 140 and may also contain general product information 142 which, in this example, merely identifies to the consumer the brand of the absorbent article being stored. One skilled in the art would appreciate that other general product information 142 may be used. Product label 143 may also contain particular product information 144, wherein, the particular product information 144 identifies to the consumer specific product details including, but not limited to, size and quantity. For example, product label 143 in FIG. 1 is intended to identify absorbent articles 103 packaged in a flexible film 105, wherein, the absorbent articles 103 are disposable diapers of size 6 jumbo. One skilled in the art would appreciate that any design and/or combination of general and/or particular product information may be used. Additionally, one skilled in the art would appreciate that product information 142, 144 may be depicted on an insert card inside a transparent and/or translucent coverplate (not shown, however, similar to FIG. 9) which is affixed to advertising panel 140. The coverplate may be made of plastic or any other suitable material. The coverplate may include an open grip area to help facilitate the removal and adding of the insert card. Product information 142 may be depicted by being directly printed or molded onto advertising panel 140 (not shown) or by any other suitable methods.

Referring to FIG. 1, apparatus 100 may be placed in close proximity to a similar and/or identical apparatus 200. Each apparatus may contain an advertising panel 140, 240 but may also contain different product labels 143 and 243; in such an example, different packages of absorbent articles 103 may be stored next to one another to optimize shelf utilization while maintaining designated locations within their respective apparatus 100, 200 so as to guide the consumer in their purchase for the correct product and to guide the store clerk for proper storing and restocking of the various product versions. For example, FIG. 1 depicts apparatus 100 being labeled so as to store size 6 jumbo disposable diapers and apparatus 200 being labeled so as to store size 5 jumbo disposable diapers. More specifically, in this non-limiting example, general product surface indicia 145*x* corresponds to general product information 142 and particular product surface indicia 145*y* corresponds to particular product information 144. One skilled in the art would appreciate that other forms and/or methods of written communication of general and/or particular product information may be used.

Figure 7:
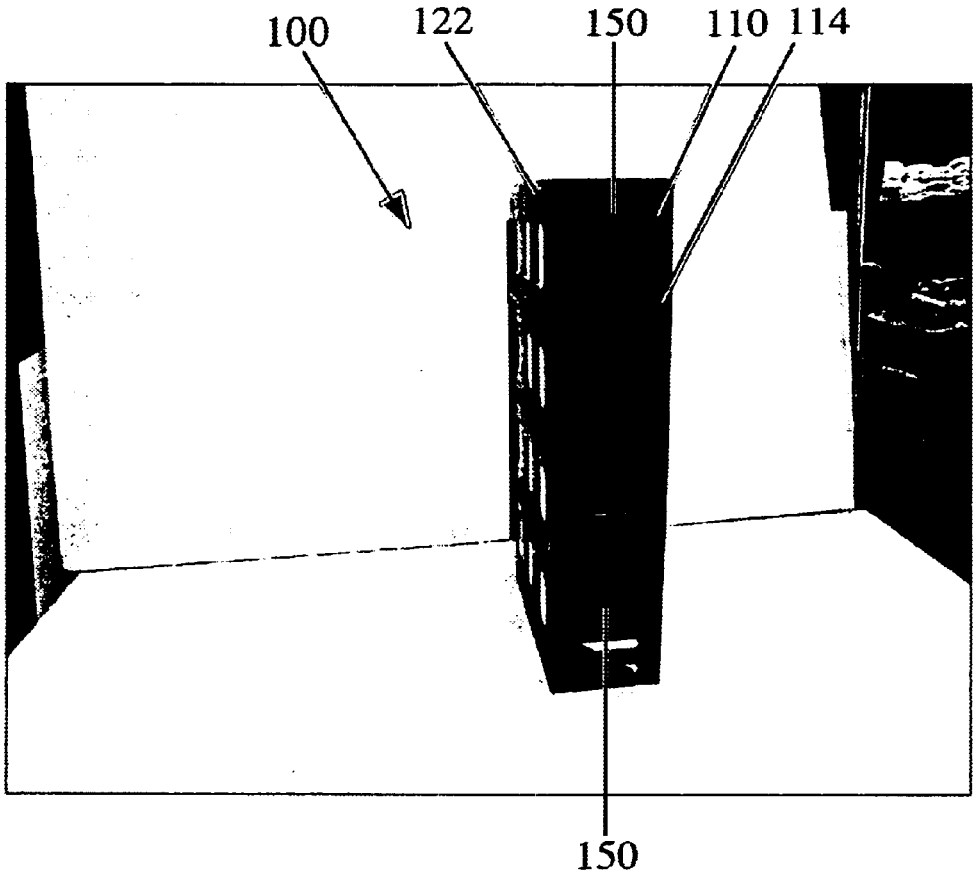
FIG. 7 is a bottom view of the apparatus in FIG. 1 without the absorbent article.

FIG. 7 depicts apparatus 100 having magnets 150 on the bottom wall second surface 114 so as to improve stability and maintain placement on a shelf. While FIG. 17 depicts two magnets 150 of identical size being used, any size and number of magnets 150 may be used. Magnets 150 may be affixed to bottom wall second surface 114 by any suitable method including, but not limited to, adhesive bonding or inserting of magnet 150 into a cavity mold. Apparatus 100 may also be adapted for positioning on a shelf by any other suitable method including, but not limited to, slot-and-tab configuration between apparatus 100) and shelf (e.g., front of shelf to front of apparatus, rear of shelf to rear of apparatus, top of shelf to bottom of apparatus), screws, nails, staples, tape, adhesive, rivets, interference fits, force fits and unitary construction via injection molding.

The edges of apparatus 100 may be constructed substantially rounded so as not to have sharp edges that may tear or puncture the flexible film 105. Apparatus 100 may be constructed using injection molding or any other suitable production methods. Apparatus 100 may be constructed of plastic (e.g., high impact polystyrene) or any other suitable materials. Apparatus 100 may be made as a unitary construction or as an assembly of discrete pieces.

Figure 8:
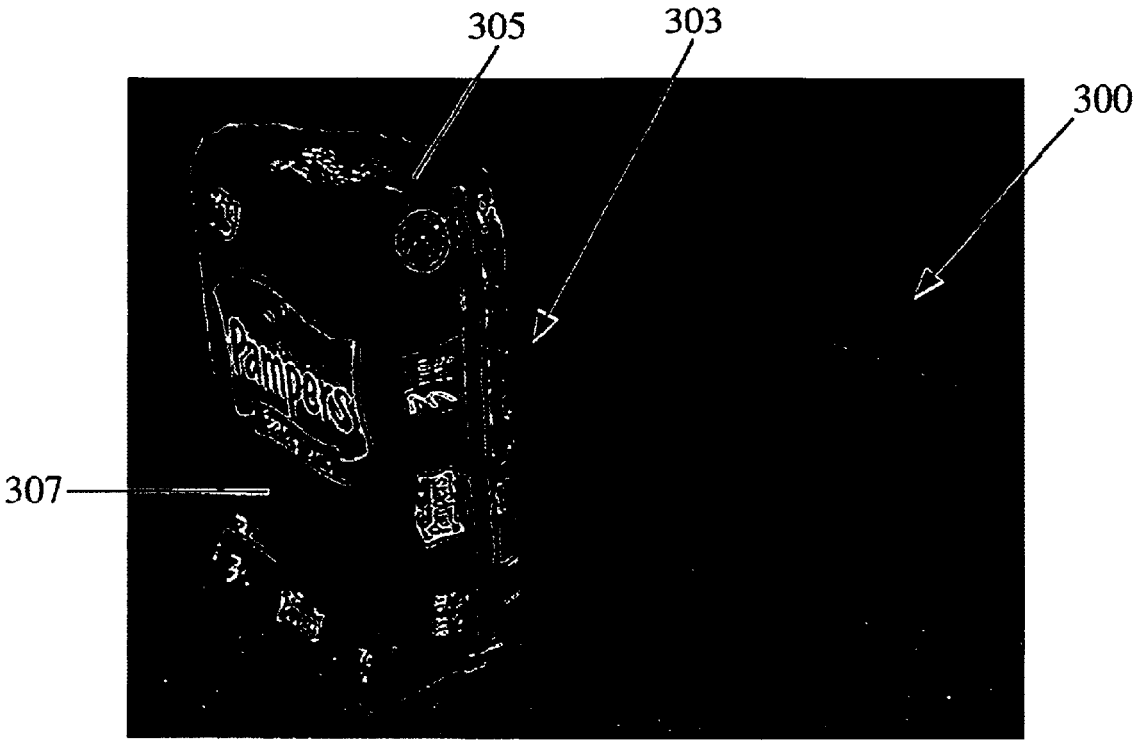
FIG. 8 is a perspective view of another shelf display apparatus and an absorbent article packaged in a flexible film in accordance with the present invention.

FIG. 8 depicts another non-limiting exemplary embodiment of a shelf display apparatus 300 which is adapted to store absorbent articles 303 which are packaged in a flexible film 305 on a shelf (not shown). Absorbent articles 303 packaged in a flexible film 305 are typically substantially rectangular in shape and have surface indicia on at least one of the major surface area sides 307. Preferably, apparatus 300 is adapted to store absorbent articles 303 such that major surface area 307 having surface indicia is facing towards the direction of the consumer (e.g., front of shelf).

Figure 9:
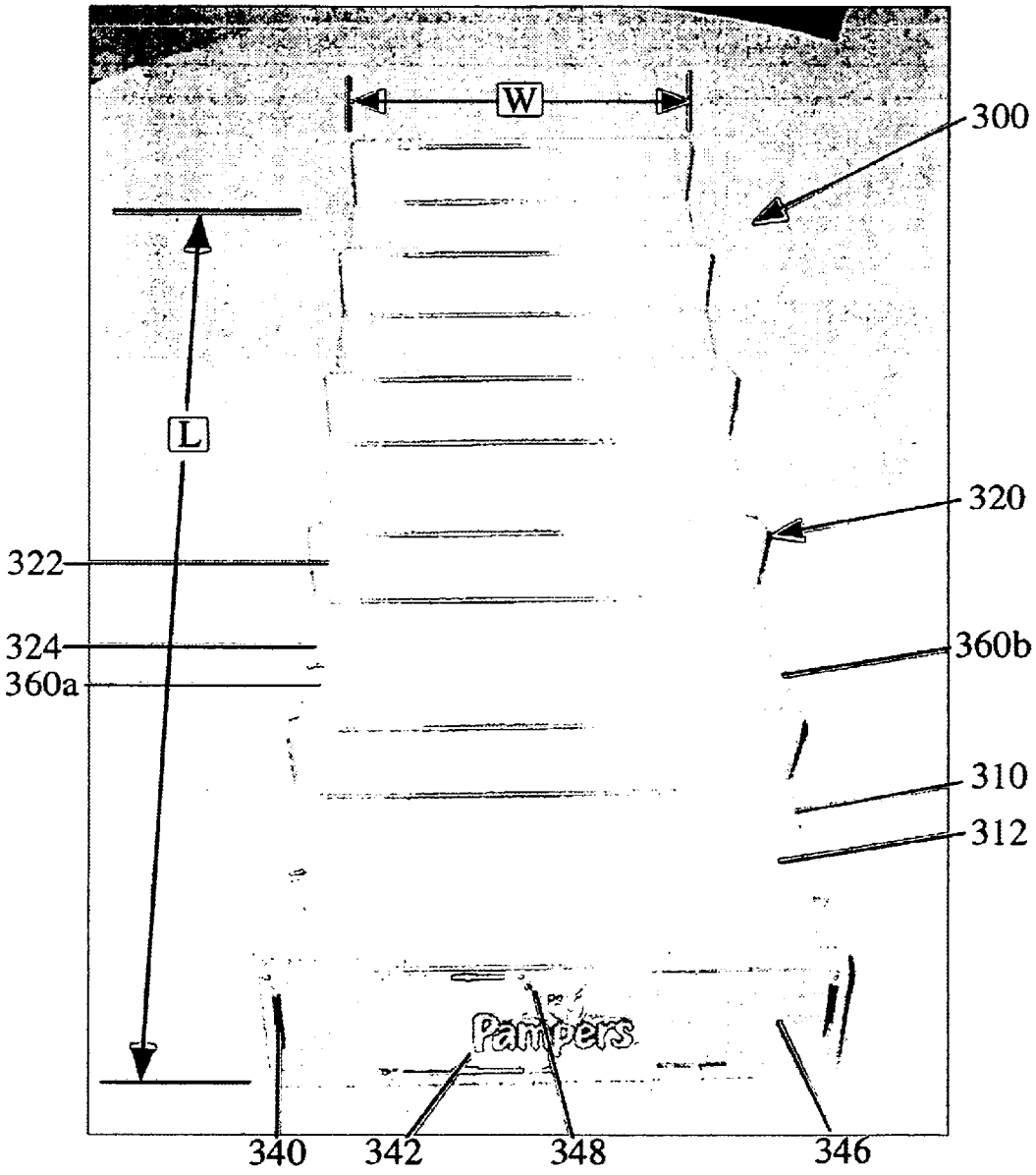
FIG. 9 is a front view of the apparatus in FIG. 8 without the absorbent article.
Figure 10:
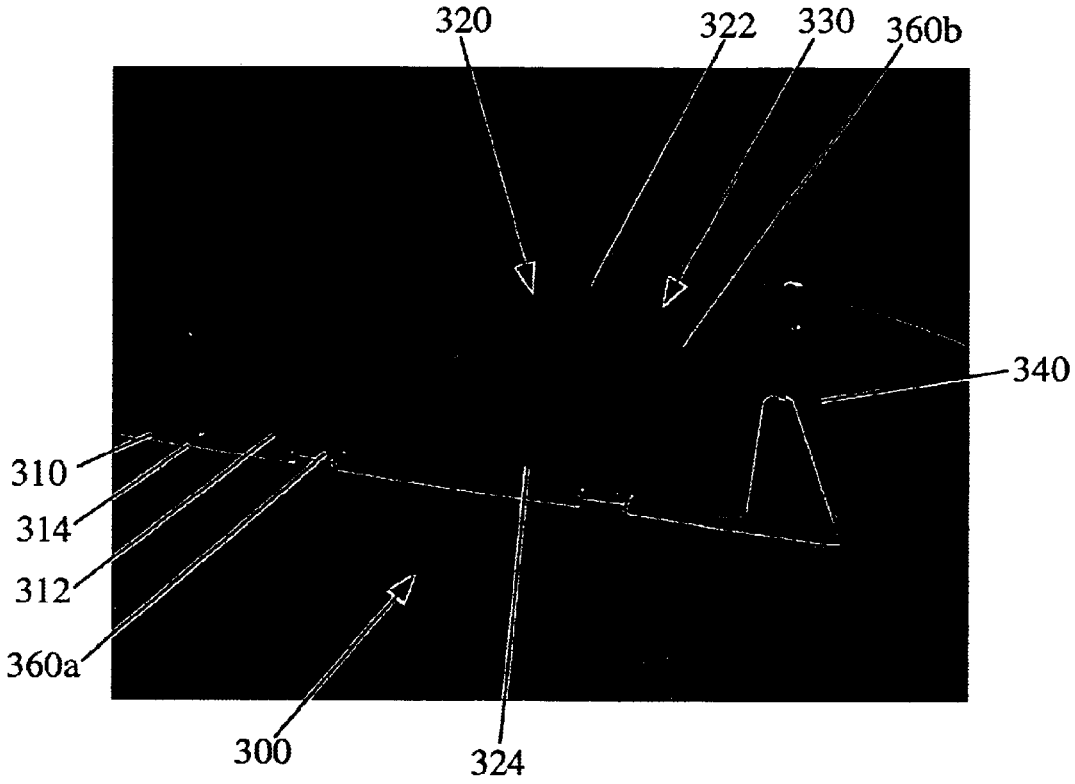
FIG. 10 is a left side view of the apparatus in FIG. 8 without the absorbent article.
Figure 11:
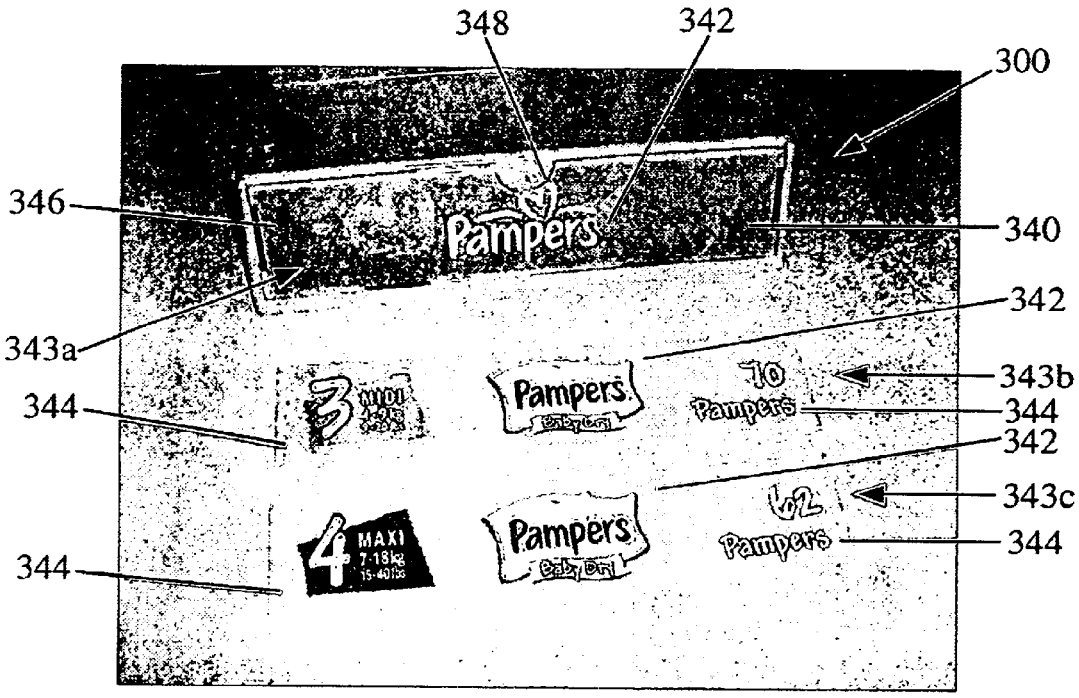
FIG. 11 is a partial front view of the apparatus in FIG. 8 without the absorbent article showing an advertising panel and an assortment of insert cards having product information.

FIGS. 9–11 depict apparatus 300 having a substantially horizontal bottom wall 310, wherein said bottom wall 310 has a first surface 312 and a second surface 314, and a support structure 320. Bottom wall 310 provides a base platform for apparatus 300 to be placed on a shelf. Bottom wall first surface 312 is the upper side of bottom wall 310 and bottom wall second surface 314 is the lower side of bottom wall 310. Support structure 320 may be designed to have a plurality of partitions 322, a plurality of recesses 324 and a plurality of storage regions 330 for storing absorbent articles 303. More specifically, partitions 322 are joined to and extend upwardly from bottom wall first surface 312. Recesses 324 are the portions of bottom wall first surface 312 which lay between partitions 322. Partitions 322 and recesses 324 together form a storage region 330. While FIG. 9 depicts partitions 322 extending substantially perpendicular from bottom wall first surface 312, one skilled in the art would appreciate that the angle between partitions 322 and bottom wall first surface 312 may vary so as to change the angled appearance of absorbent articles 303. Apparatus 300 may also include an advertising panel 340 to display product information 342, 344 relating to absorbent articles 303.

FIG. 11 depicts three non-limiting examples of an insert card 343 which may be affixed to advertising panel 340. Insert card 343*a* contains general product information 342 which, in this example, merely identifies to the consumer the brand of the absorbent article being stored. One skilled in the art would appreciate that other general product information 342 may be used. Insert cards 343*b* and 343*c* contain general product information 342 and particular product information 344, wherein, the particular product information 344 identifies to the consumer specific product details including, but not limited to, size and quantity. For example, insert card 343*b* is intended to identify absorbent articles 303 packaged in a flexible film 305, wherein absorbent articles 303 are disposable diapers of size 3 and seventy diapers are packaged together. Similarly, insert card 343*c* is intended to identify absorbent articles 303 packaged in a flexible film 305, wherein absorbent articles 303 are disposable diapers of size 4 and sixty-two diapers are packaged together. One skilled in the art would appreciate that any design and/or combination of general and/or particular product information may be used. Additionally, one skilled in the art would appreciate that product information 342, 344 may be depicted on a sticker (not shown, however, similar to FIG. 1) which is adhered to advertising panel 340, directly printed or molded onto advertising panel 340 (not shown), or depicted by any other suitable methods. Advertising panel 340 may also include a transparent and/or translucent coverplate 346 which holds insert card 343 in place. Coverplate 346 may be made of plastic or any other suitable material. Coverplate 346 may include an open grip area 348 to help facilitate the removal and adding of insert card 343.

Figure 12:
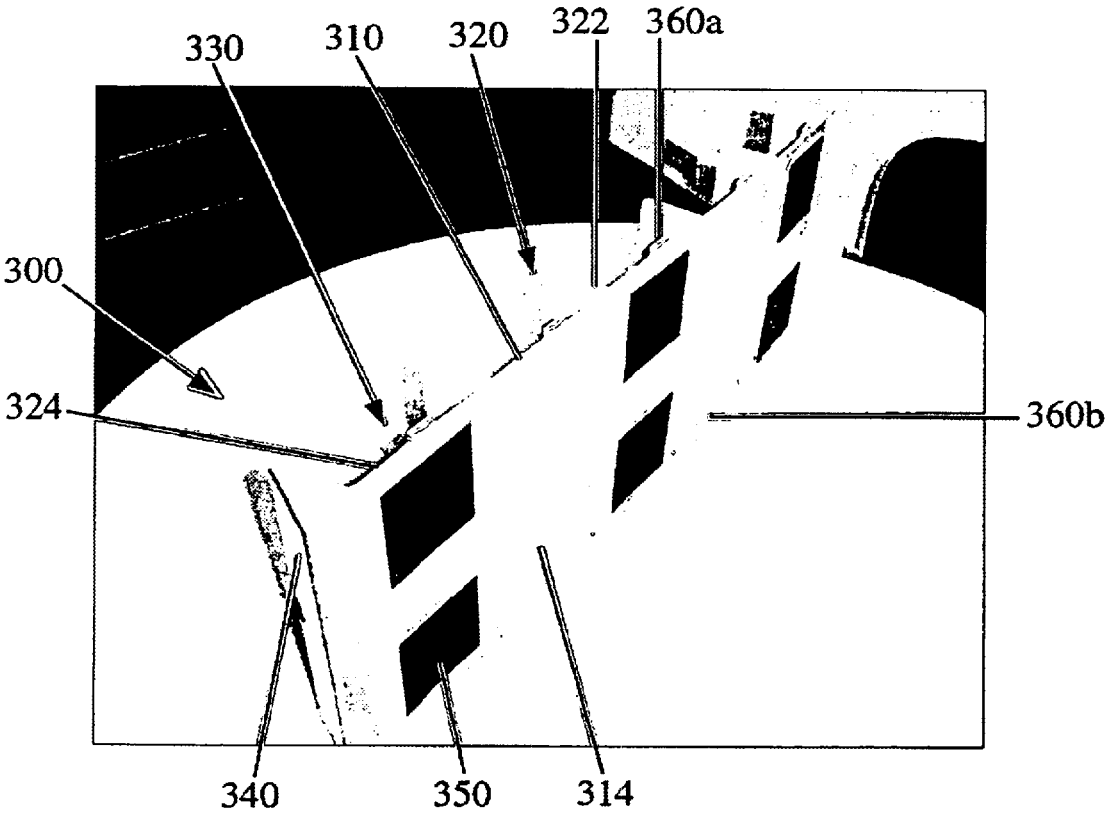
FIG. 12 is a bottom view of the apparatus in FIG. 8 without the absorbent article.

FIG. 12 depicts apparatus 300 having magnets 350 on the bottom wall second surface 314 so as to improve stability and maintain placement on a shelf. While FIG. 12 depicts six magnets 350 of identical size being used, any size and number of magnets 350 may be used. Magnets 350 may be affixed to bottom wall second surface 314 by any suitable method including, but not limited to, adhesive bonding or inserting of magnet 350 into a cavity mold. Apparatus 300 may also be adapted for positioning on a shelf by any other suitable method including, but not limited to, slot-and-tab configuration between apparatus 300 and shelf (e.g., front of shelf to front of apparatus, rear of shelf to rear of apparatus, top of shelf to bottom of apparatus), screws, nails, staples, tape, adhesive, rivets, interference fits, force fits and unitary construction via injection molding.

The edges of apparatus 300 may be constructed substantially rounded so as not to have sharp edges that may tear or puncture the flexible film 305. Apparatus 300 may be constructed using injection molding or any other suitable production methods. Apparatus 300 may be constructed of plastic (e.g., high impact polystyrene) or any other suitable materials. Apparatus 300 may be made as a unitary construction or as an assembly of discrete pieces.

Figure 13:
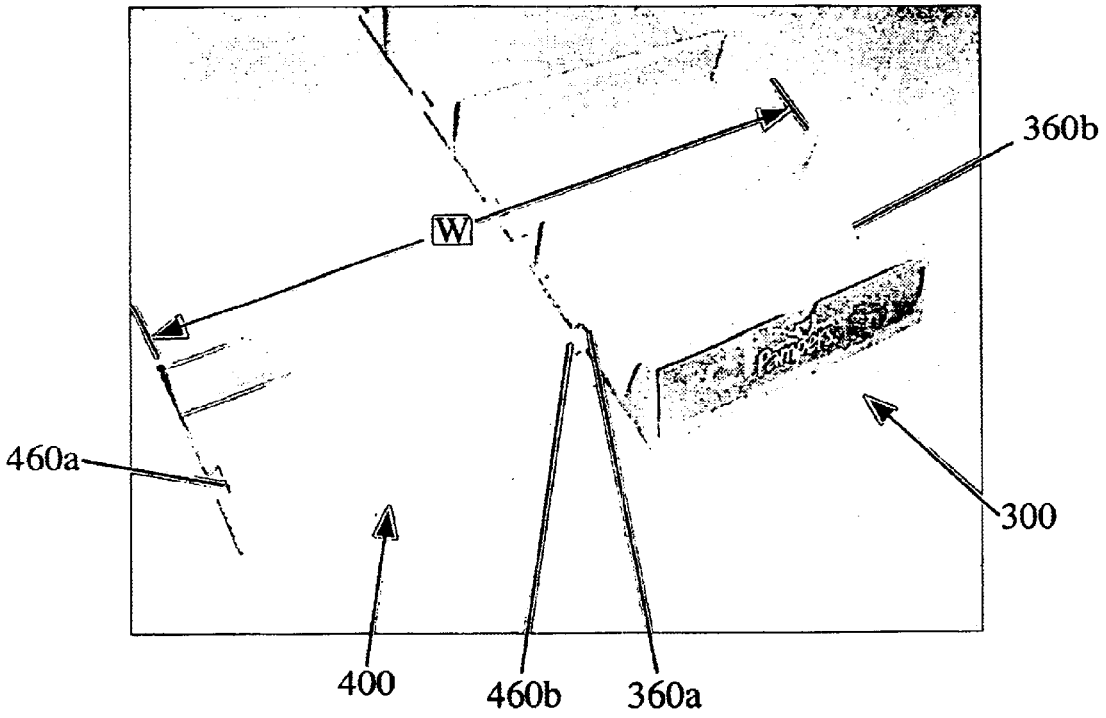
FIG. 13 is a perspective view of the apparatus in FIG. 8 without the absorbent article and a second apparatus having matching interlocking members.
Figure 14:
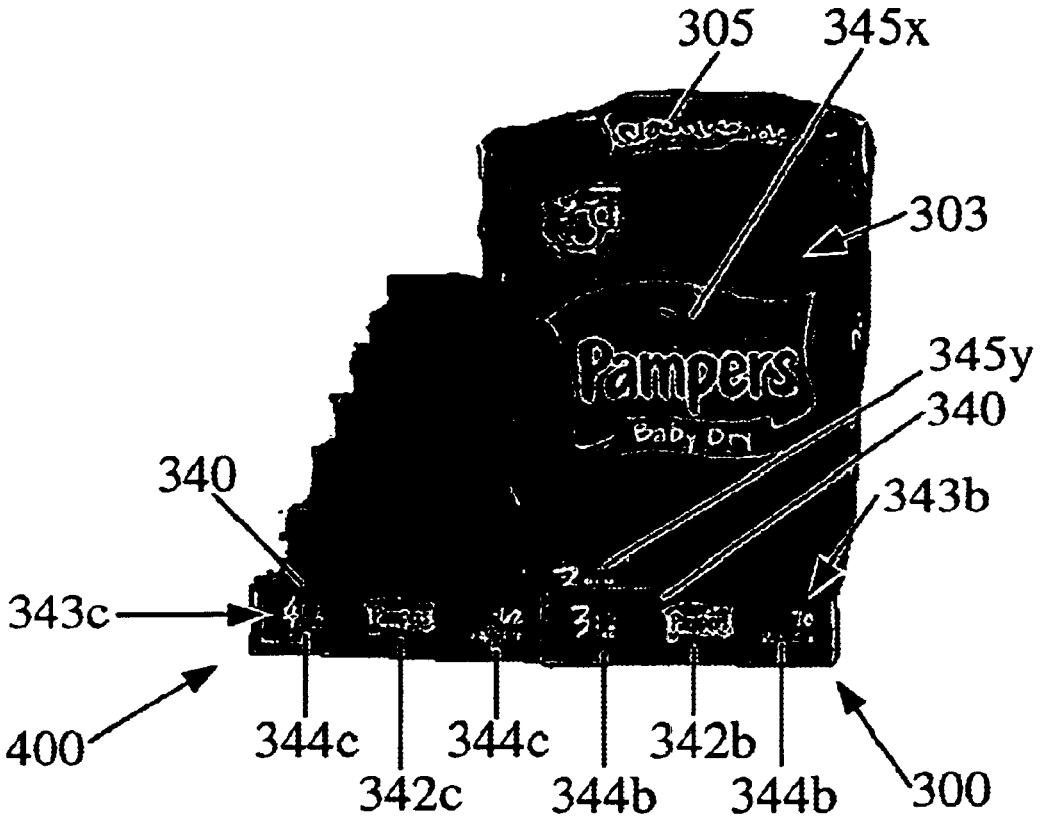
FIG. 14 is a perspective view of the apparatus in FIG. 8 storing an absorbent article and a second apparatus having matching interlocking members, wherein the absorbent article has surface indicia which matches the product information displayed on the advertising panel.

FIGS. 9–14 depict apparatus 300 having interlocking members 360*a* and 360*b*. Referring to FIG. 13, apparatus 300 may be connected to a similar and/or identical apparatus 400 having corresponding interlocking members 460*a* and 460*b* to provide greater stability and to optimize shelf utilization by changing the overall width "w" of a series of apparatuses. Referring to FIG. 14, apparatus 300 and apparatus 400 may each contain an advertising panel 340 but may also contain different insert cards 343*b* and 343*c*; in such an example, different packages of absorbent articles 303 may be stored next to one another to optimize shelf utilization while maintaining designated locations within their respective apparatus 300, 400 so as to guide the consumer in their purchase for the correct product and to guide the store clerk for proper storing and restocking of the various product versions. For example, FIG. 14 depicts apparatus 300 being labeled so as to store seventy size 3 disposable diapers and apparatus 400 being labeled so as to store sixty-two size 4 disposable diapers. More specifically, in this non-limiting example, general product surface indicia 345*x* corresponds to general product information 342*b* and particular product surface indicia 345*y* corresponds to particular product information 344*b*. One skilled in the art would appreciate that other forms and/or methods of written communication of general and/or particular product information may be used.

Figure 15:
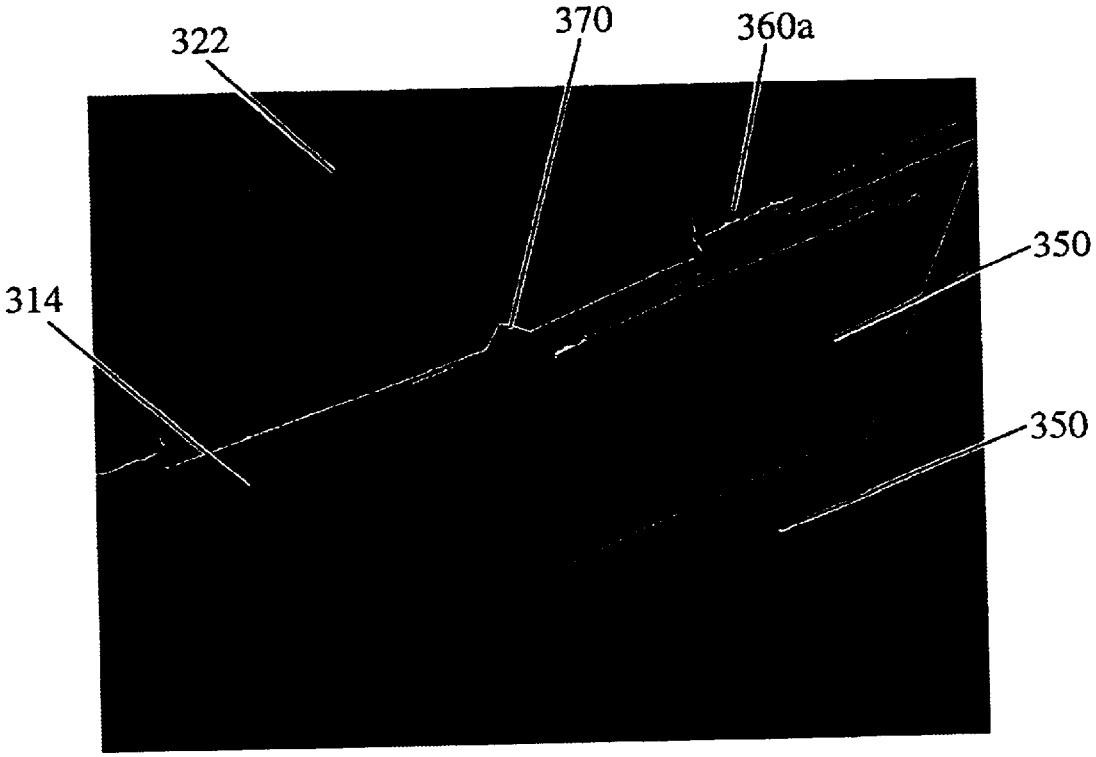
FIG. 15 is a bottom view of the apparatus in FIG. 8 showing a snap-off which allows for lateral length adjustment of the apparatus.
Figure 1:
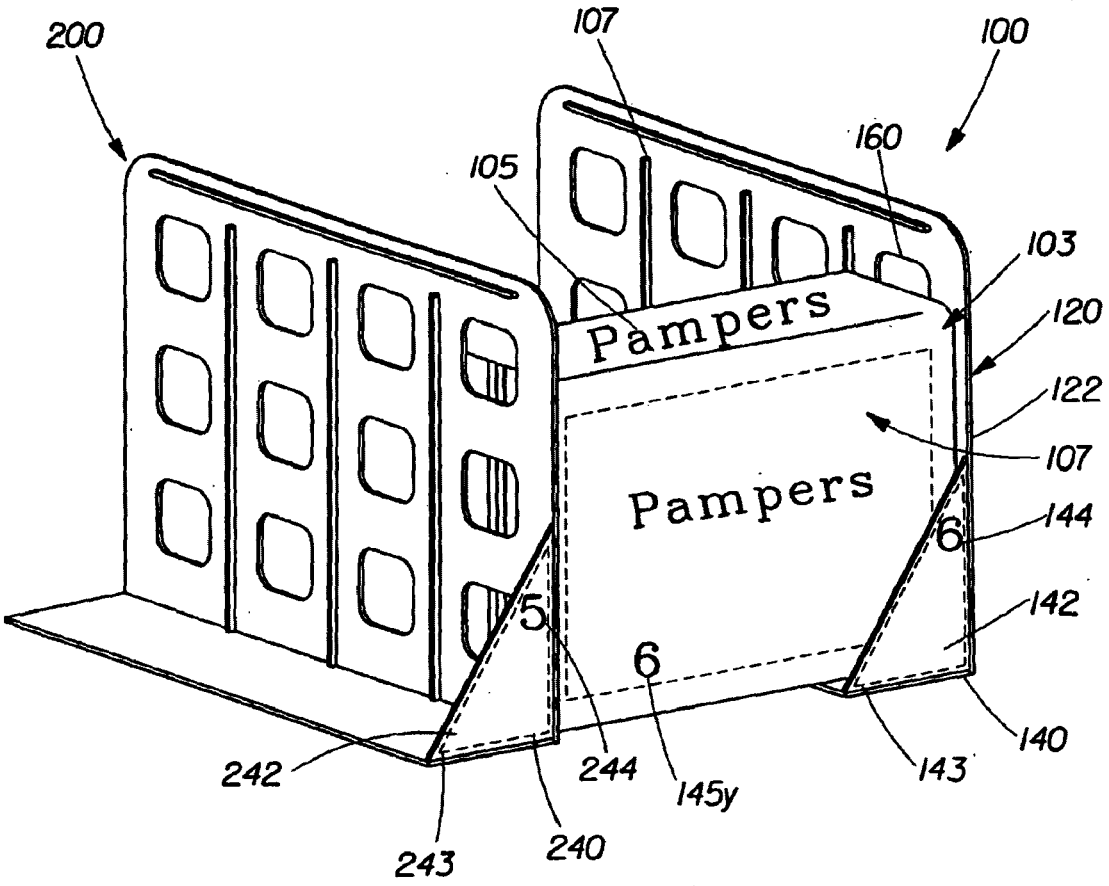
Figure 2:
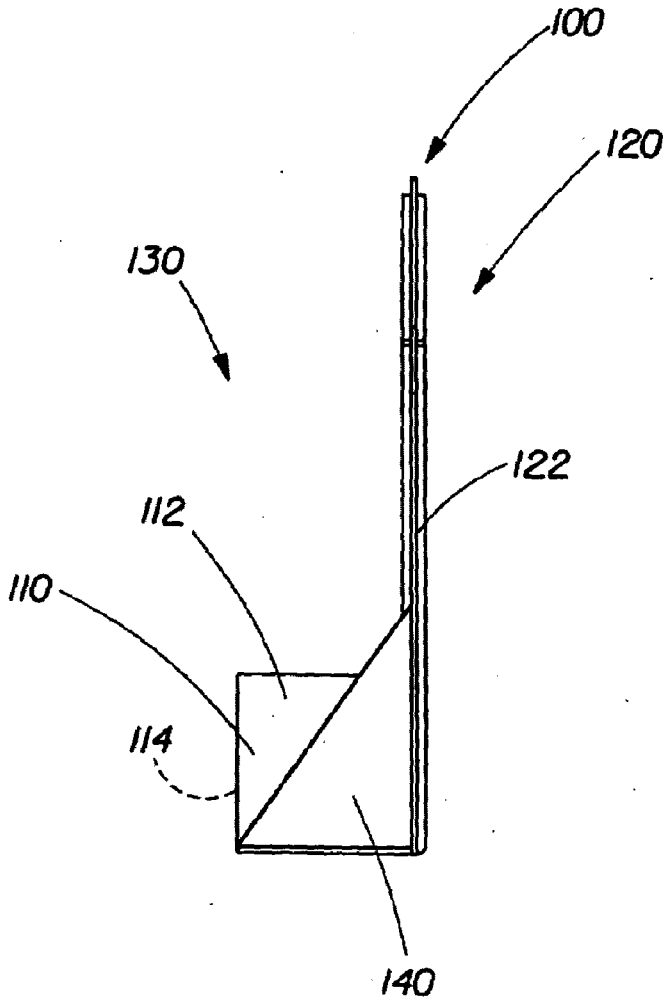
Figure 3:
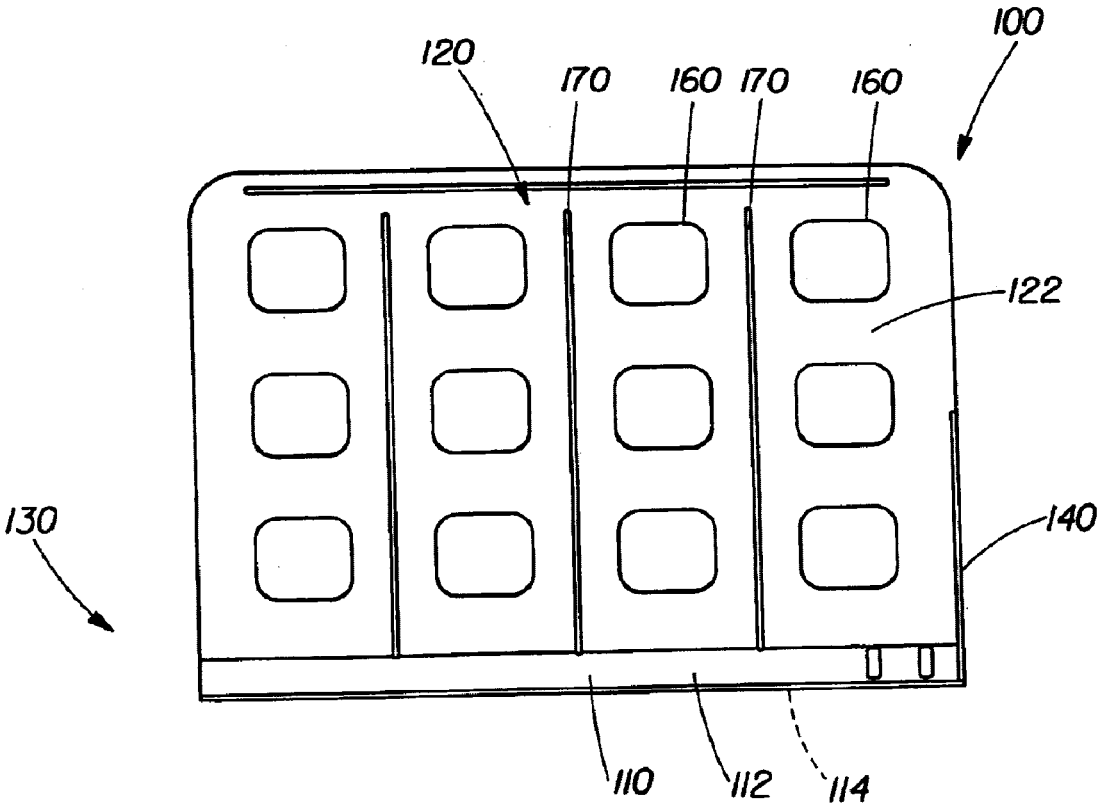
Figure 4:
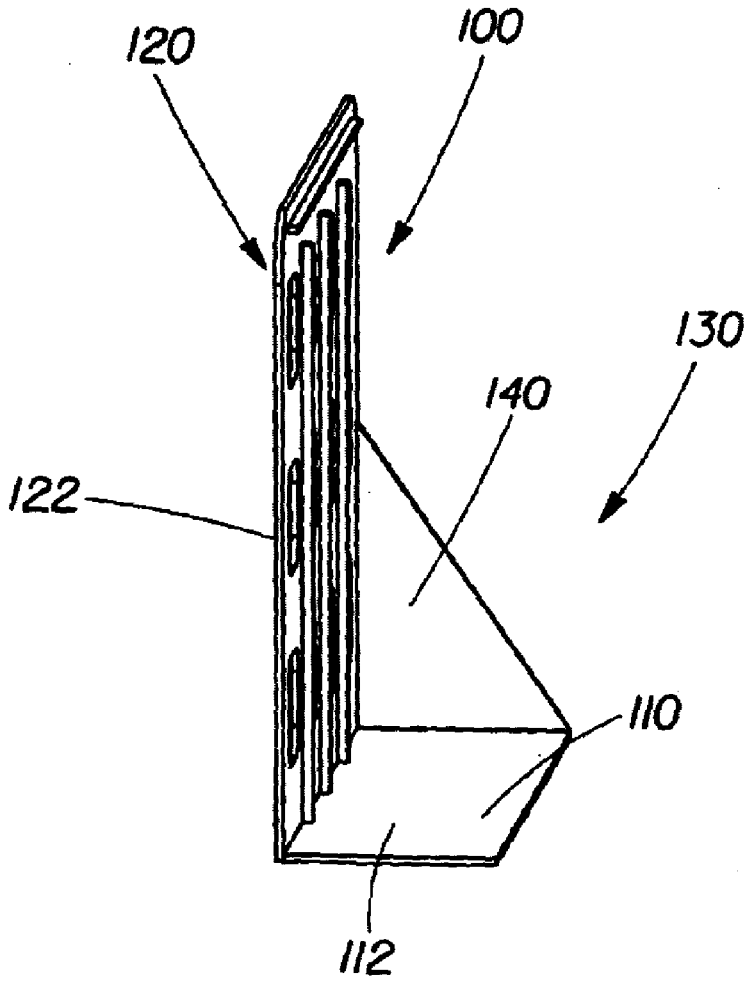
Figure 5:
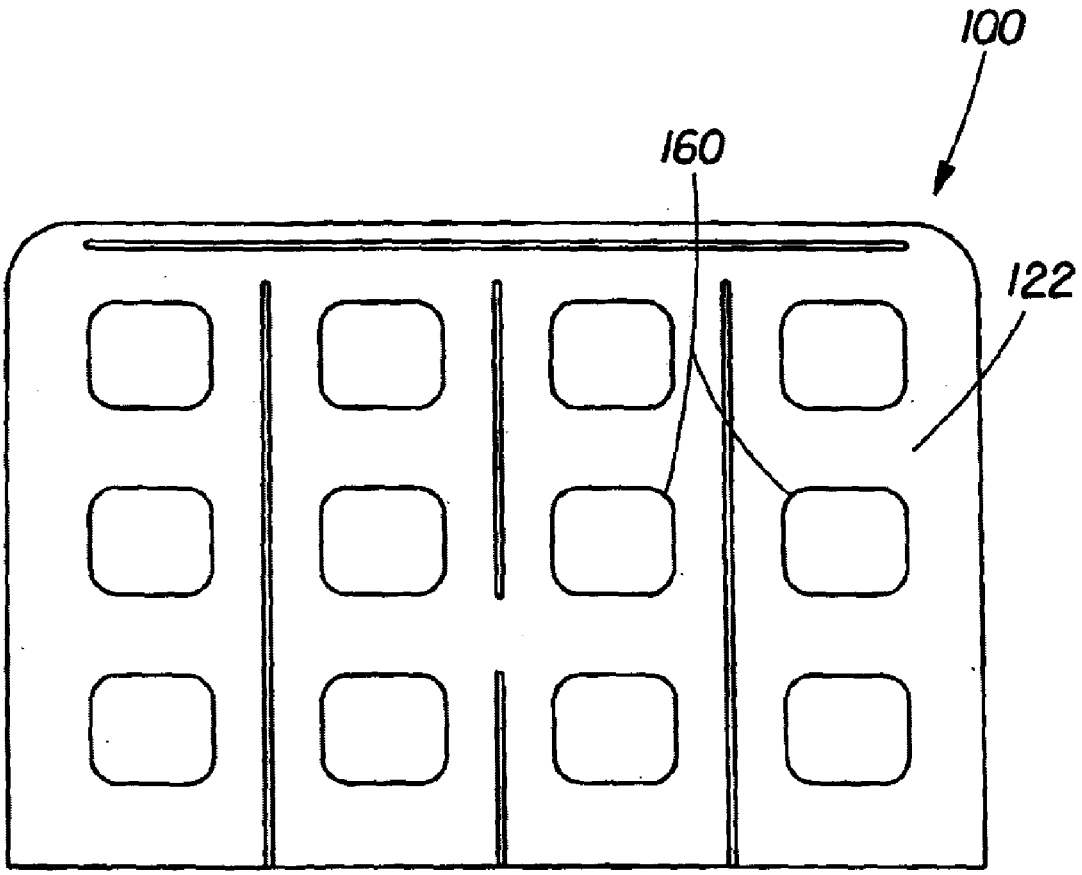
Figure 6:
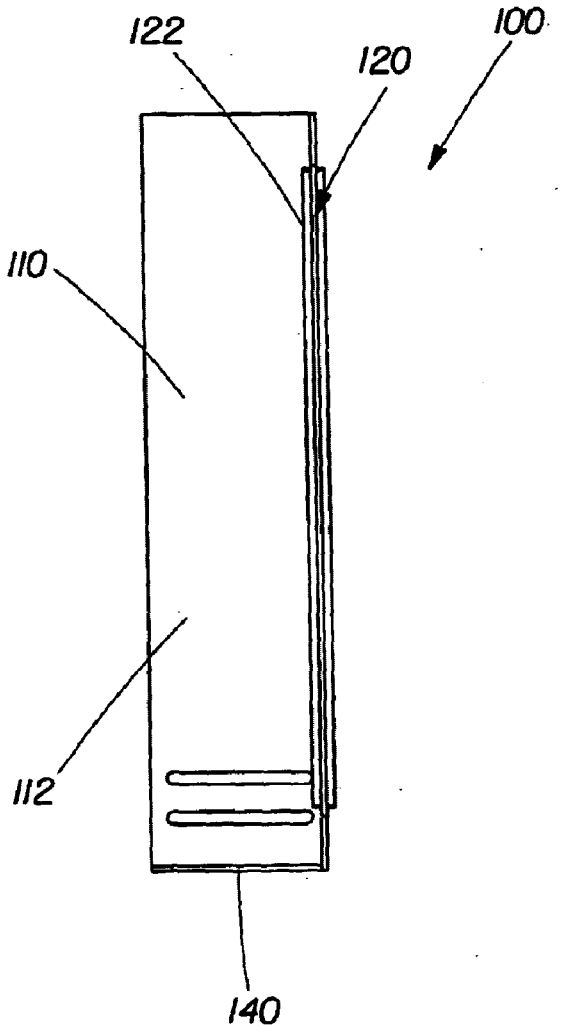
Figure 7:
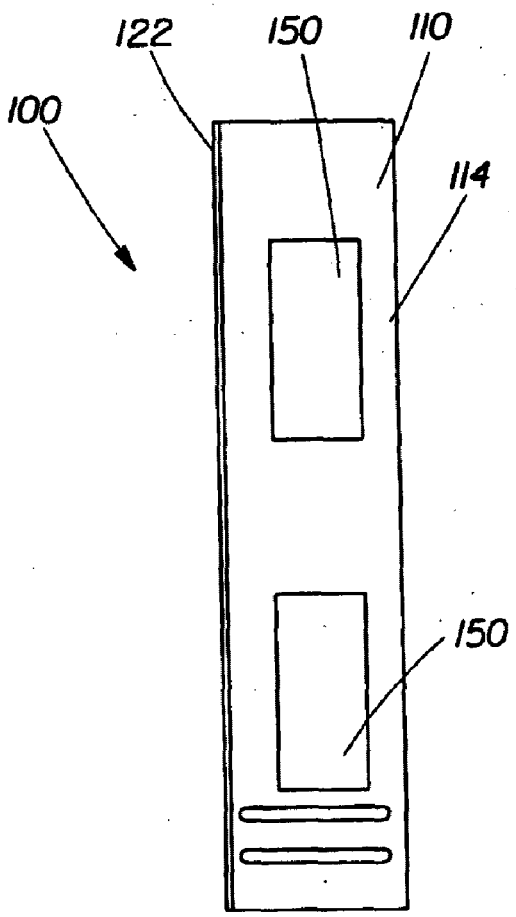
Figure 8:
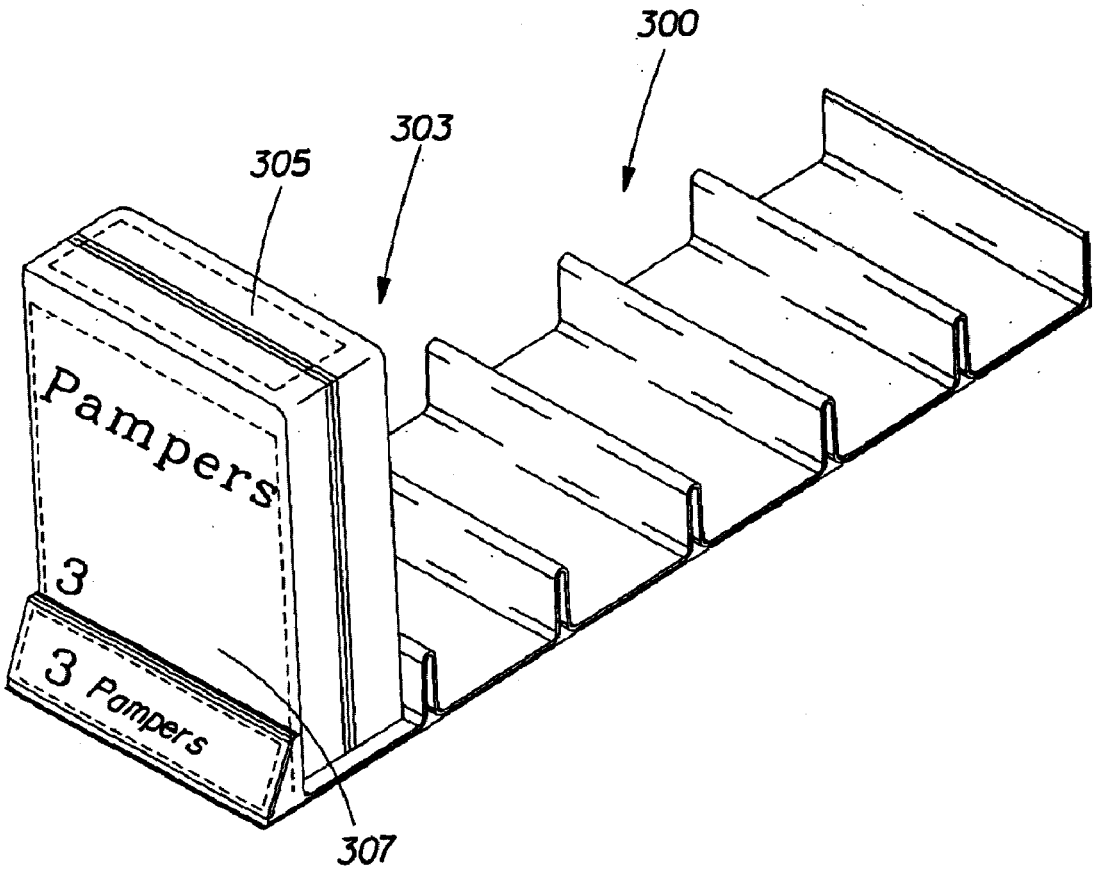
Figure 9:
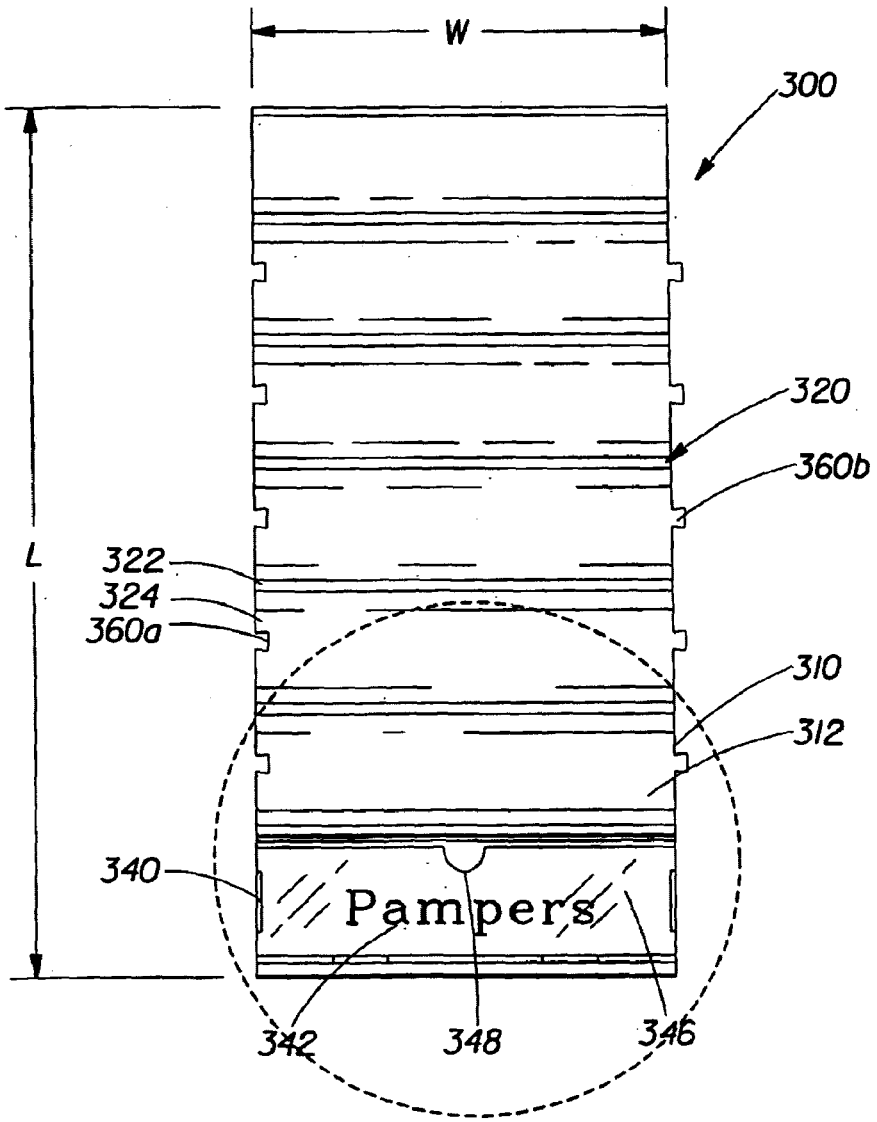
Figure 10:
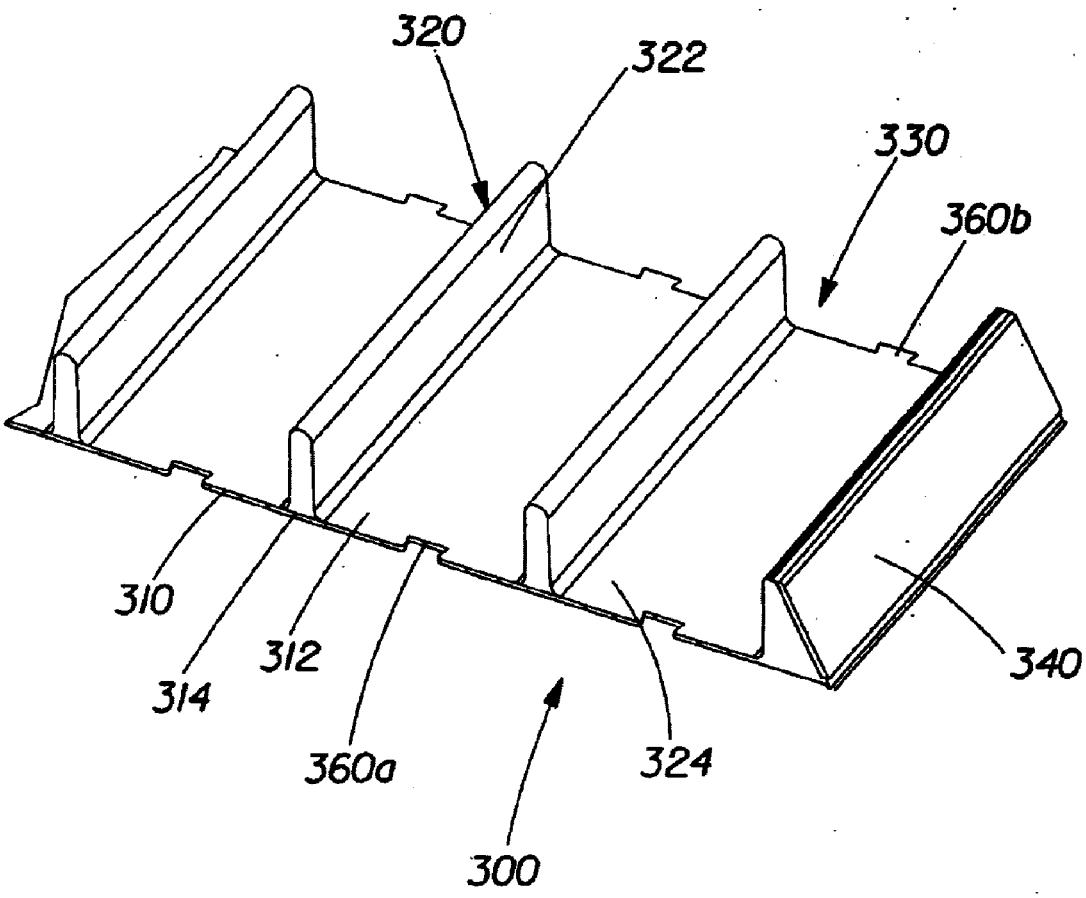
Figure 11:
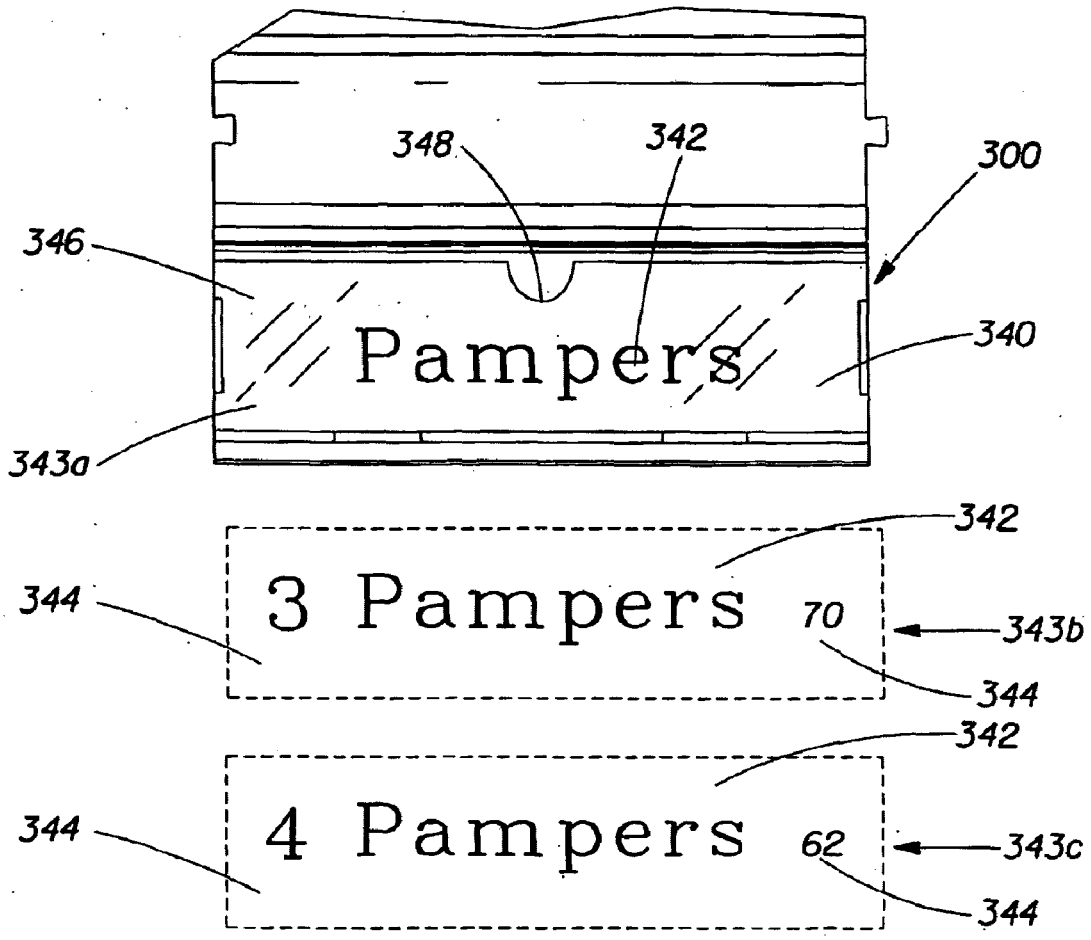
Figures 12, 15:
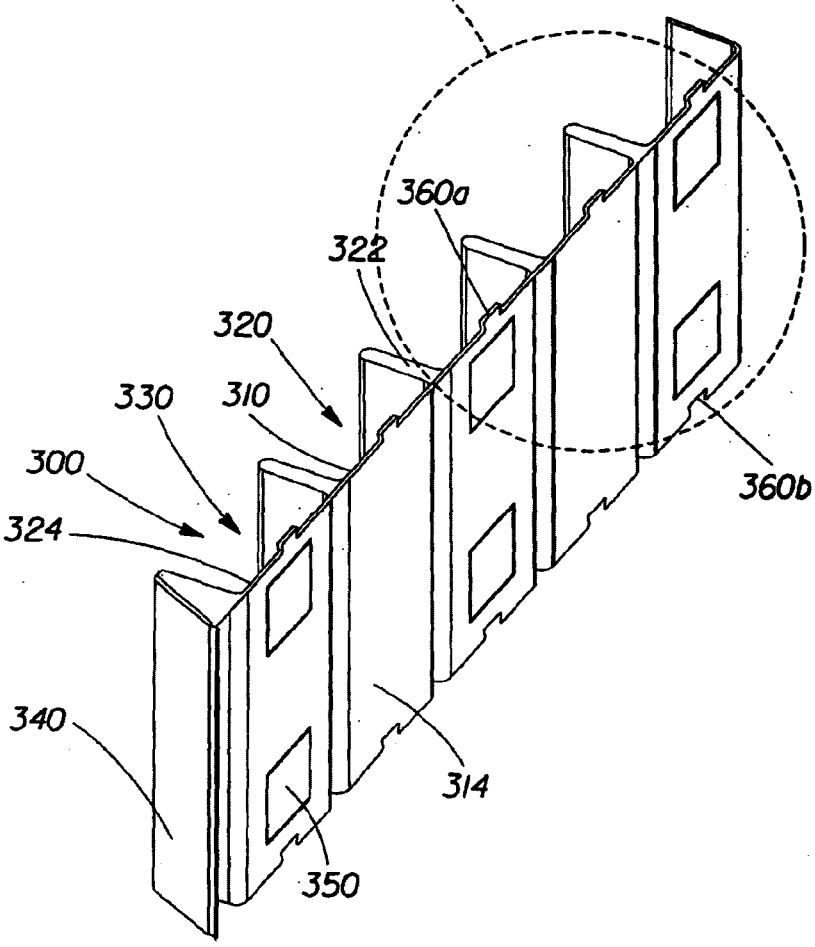
Figure 13:
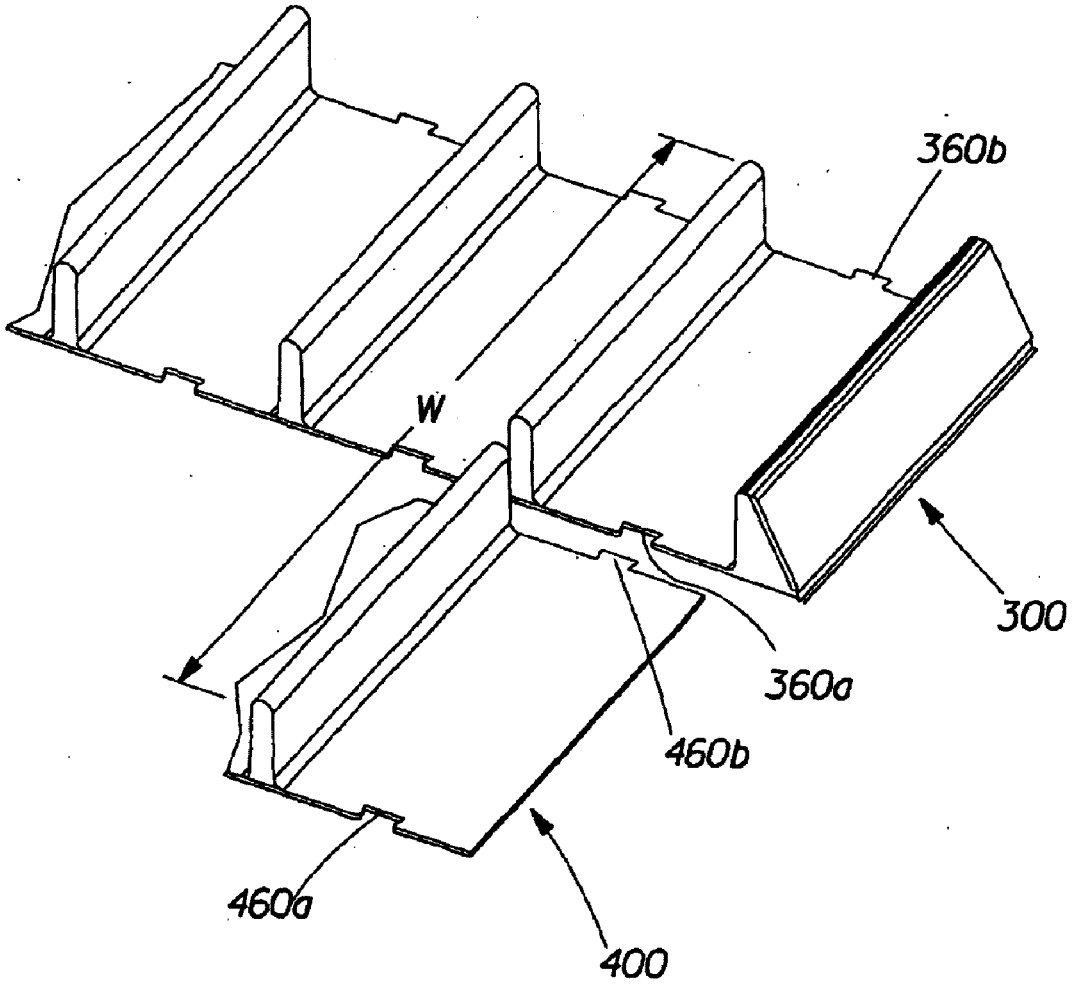
Figure 14:
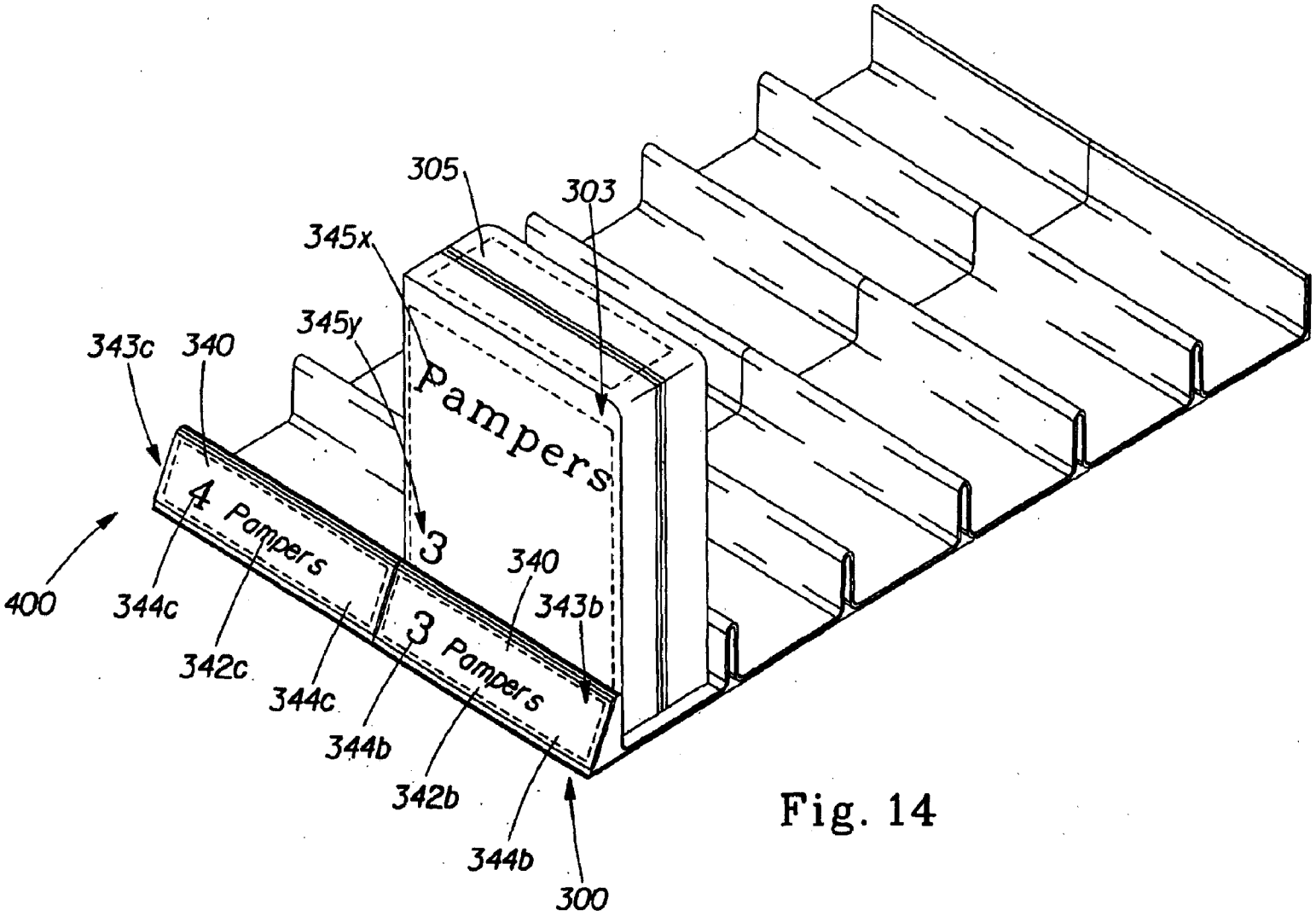
Figure 15:
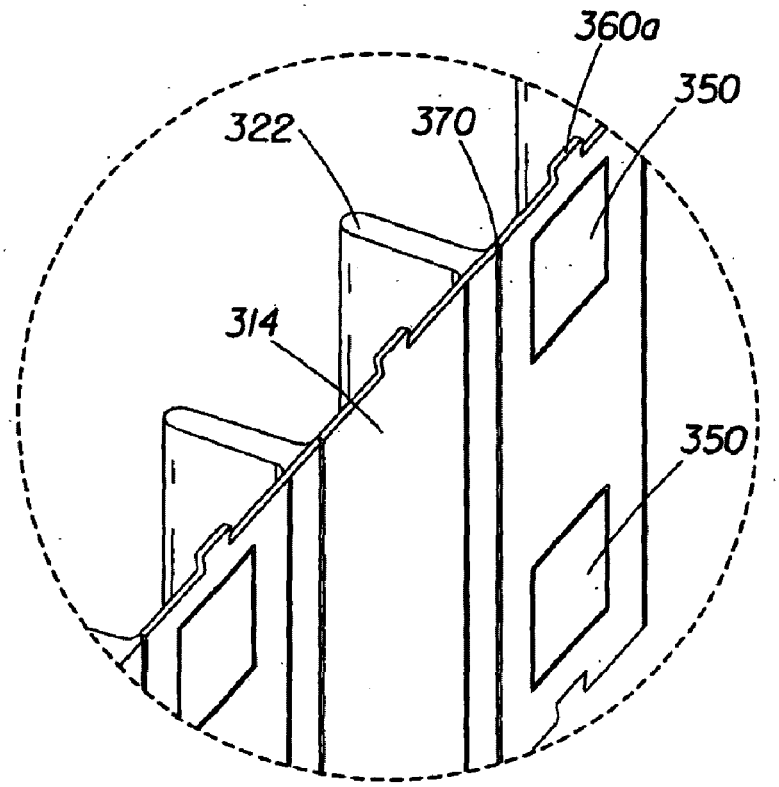

FIG. 15 depicts apparatus 300 having at least one snap-off 370 to allow a store clerk or product manufacturer to reduce the overall length (shown as "l" in FIG. 9) by bending apparatus 300 along this lateral weakened portion of bottom wall 310. Reducing the overall length of apparatus 300 is sometimes necessary to accommodate shallower store shelves. One skilled in the art would appreciate that other construction/molding techniques and/or designs may be used to provide weakened portions to provide snap-off functionality. Conversely, while not shown, interlocking members similar to 360*a* and 360*b* may be used to increase the overall length of apparatus 300.

While the advantages of the present invention may certainly be appreciated on a store shelf, the present invention may also be appreciated at other locations where storing absorbent articles in this manner may be desired (e.g., consumer's home).

While a package of absorbent articles typically takes the shape of substantially rectangular, one skilled in the art would appreciate that other shapes (e.g., trapezoidal) may be used with the present invention, as exampled in co-pending applications WO 01/68022A1 (filed Mar. 10, 2000, published Sep. 9, 2001) and U.S. Ser. No. 10/423,425 (filed on Apr. 25, 2003, claiming priority of May 28, 2002). Additionally, the present invention may prove especially useful for packages of absorbent articles where the absorbent articles are not highly compacted in the flexible film such that the package is not substantially free-standing, as exampled in co-pending applications WO 01/68022A1 (filed Mar. 10, 2000, published Sep. 9, 2001).

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A combination of a shelf display apparatus and an absorbent article which is packaged in a flexible film, said apparatus comprising:

a substantially horizontal bottom wall, said bottom wall having a first and second surface;

a support structure; and at least one absorbent article packaged in a flexible film;

wherein said support structure is joined to and extends upwardly from said bottom wall; wherein said support structure and said bottom wall first surface together provide a storage region adapted to store substantially upright absorbent articles which are packaged in a flexible film, wherein said apparatus is adapted for placement on a shelf.

2. The absorbent article packaged in a flexible film of claim 1 wherein a resulting package shape is substantially rectangular.

3. The absorbent article packaged in a flexible film of claim 1 wherein a resulting package shape is not substantially rectangular.

4. A method for storing absorbent articles which are packaged in a flexible film on a shelf in a substantially upright position, said method comprising:

placing a first display shelf apparatus on a shelf, wherein said apparatus contains:

a substantially horizontal bottom wall, said bottom wall having a first and second surface;

a support structure; and a first absorbent article packaged in a flexible film;

wherein said support structure is joined to and extends upwardly from said bottom wall;

wherein said support structure and said bottom wall first surface together provide a storage region adapted to store substantially upright absorbent articles which are packaged in a flexible film, wherein said apparatus is adapted for placement on a shelf; and placing at least one absorbent article in said apparatus, wherein said absorbent article is positioned in a substantially upright orientation.

5. The method of claim 4 further comprising the step of attaching a second display shelf apparatus to said first apparatus to increase an overall width of occupied shelf space.

6. The method of claim 5 further comprising the step of placing a second absorbent article in said second apparatus, wherein said second absorbent article is different than said first absorbent article.

7. The method of claim 5 further comprising the step of placing a second absorbent article in said second apparatus, wherein said second absorbent article is substantially the same as said first absorbent article.

8. A shelf apparatus for absorbent articles which are packaged in a flexible film, said apparatus comprising: a substantially horizontal bottom wall, said bottom wall having a first and second surface; a plurality of partitions extending from said bottom wall first surface, wherein said partitions are joined to and extend upwardly from said bottom wall, wherein said recesses and partitions provide a storage region adapted to store said substantially upright absorbent articles which are packaged in a flexible film, wherein said apparatus is adapted for placement on a shelf and further comprising at least one snap-off, whereby overall length of said shelf apparatus may be altered to accommodate a variety of different shelf lengths.

* * * * *

UNITED STATES PATENT AND TRADEMARK OFFICE

CERTIFICATE OF CORRECTION

PATENT NO. : 6,889,856 B2 
DATED : May 10, 2005
INVENTOR(S) : Sean Thomas Clark et al.

It is certified that error appears in the above-identified patent and that said Letters Patent is hereby corrected as shown below:

Replace Drawing Sheets 1 through 15, consisting of Figures 1-15 with the attached drawing sheets.

Signed and Sealed this

Eleventh Day of April, 2006

JON W. DUDAS
*Director of the United States Patent and Trademark Office*